United States Patent [19]

Schick

[11] 4,071,234

[45] Jan. 31, 1978

[54] HIGH PERFORMANCE SHEET-FEEDER MECHANISM

[75] Inventor: Günther Schick, Bielefeld, Germany

[73] Assignee: Grapha-Holding AG, Hergiswil, Switzerland

[21] Appl. No.: 704,499

[22] Filed: July 12, 1976

[30] Foreign Application Priority Data

July 12, 1975 Germany ..... 2531262

[51] Int. Cl.[2] ..... B65H 3/08; B65H 3/40

[52] U.S. Cl. ..... 271/11; 271/30 A; 271/91; 271/100; 271/107; 271/151

[58] Field of Search ..... 271/11, 30 A, 90, 91, 271/99–101, 105–108, 150, 151, 216

[56] References Cited

U.S. PATENT DOCUMENTS

| | | | |
|---|---|---|---|
| 1,504,862 | 8/1924 | Brooks | 271/101 |
| 2,133,260 | 10/1938 | Wolff | 271/216 X |
| 2,566,175 | 8/1951 | Danielsson | 271/91 |
| 2,756,049 | 7/1956 | Stolz | 271/91 |
| 3,802,696 | 4/1974 | Shigemori et al. | 271/108 |

*Primary Examiner*—Robert W. Saifer
*Attorney, Agent, or Firm*—Peter K. Kontler

[57] ABSTRACT

A feeder mechanism for feeding single sheets, folios or multiple-ply material of paper or the like to subsequent processing machinery. A stack of sheets is partially tilted and edge portions of the front sheet are grasped and bent over by alternately approaching suction devices. While one of the suction devices engages the edge portion of one sheet, the previously detached sheet is being engaged by a conveyor wheel which pulls it completely from the stack.

6 Claims, 4 Drawing Figures

HIGH PERFORMANCE SHEET-FEEDER MECHANISM

BACKGROUND OF THE INVENTION

The invention relates to a feeder mechanism for single or folded sheets of paper or similar flexible sheets and serves for supplying sheets to a rapidly operating production machine in the paper processing and printing industry. Such feeding mechanisms are used, for example, for collating machines, folding machines, stapling machines, leaf insertion machines and end-paper gluing machines. One or several of these machines are used in each case for handling discrete sheets and for transporting them to the processing machinery.

Such feeder mechanisms are usually constructed in such a manner as to be replenishable from the top, by hand or otherwise, while the individual items are pulled off cyclically at the bottom. Such a manner of operation insures uninterrupted production.

The singularization of the sheets is generally performed by suction cups which first adhere to the lowermost sheet or the lowermost page of a folded item, generally at one edge, and serve to bend that item away from the remaining stack by a certain angle. Subsequently, the released sample is grasped by grippers or is caught between pull-off rollers and is pulled from beneath the remaining stack. Subsequently, the suction cups again go into operation to remove the following sheet or folded material, etc.

All feeding mechanisms operate in this way, with the exception of those feeding cardboard whose thickness makes it possible to pull off single items by means of stepped slides. If the material is sufficiently thick or is a multi-layer product, there may, in some cases, be present only a stepped slide without suction cups. However, the single sheet removal by means of suction cups is far and away the most commonly used method of operation of paper feed mechanisms.

Feeder mechanisms available at the present time and using vacuum for operation permit operating speeds of only approximately 15,000 items per hour. This limit is due to the fact that the suction device which is used for separating a sheet can be moved into position to grasp the following sheet only after the first item has been completely pulled out from under the remaining stack, because otherwise it would cover the contact point of the suction cup.

As a consequence, the return stroke of the suction cup toward the stack cannot take place at an earlier time. Only after the complete removal of a sheet is it possible to build up the vacuum in the suction cup and to initiate the strip-off motion. It is clear that the common manner of operation for all of the feeder mechanisms serves to limit the speed of operation. In addition to this disadvantage regarding the operating speed, there are of course other factors which also act to reduce the operating speed. These are, e.g., the long control lines from the vacuum controlled valves to the suction cups which require a change of the vacuum in dependence on operating speed, as well as the solenoid valves for controlling the vacuum and the many reciprocating motions of retainer devices, splitting wedges, pull-off mechanisms, or, if rotating pull-off drums are used, the extremely rapid motion of the grippers, which is opposite the direction of rotation, which hold the separated item on the pull-off drum and may tear it because the item is accelerated very rapidly from zero speed to the pull-off speed, and all these are only a few of the many disadvantages inherent in the known mechanisms. All of these mechanisms have one or several of these disadvantages and all of them pull off the single items with distinct separations between them. Certain feeder mechanisms for uninterrupted operation, such as used especially in large sheet-printing machines, may also employ a pull-off and singularization process that uses several conveyor speeds, but in these cases the singularization of the sheets occurs from the top of the stack and the stack cannot be refilled without certain supplementary manipulations which may, in fact, require stopping the machine.

Finally, one should mention the so-called round stack feeders in which the paper sheets can be supplied uninterruptedly and which are deflected and stacked in staggered form so that a suction roller is able to pull them off one by one. But in this machine also, the suction roller can pull off a sheet only after the previous sheet has been completely pulled out of the stack, which again entails the above-described velocity-limiting disadvantage. Furthermore, such round stack feeders are not usable for a folded material. Purely rotating feeders in which the suction cups are also rolling beneath the stack so as to peel off an individual item from beneath the stack have been found to produce no substantial velocity increase.

The operating speed of production machinery, especially of so-called insertion machinery, which inserts advertising copy into newspapers for example, far exceeds the operating speed of the feeder mechanisms known at the present time so that feeder mechanisms with increased operating speed are extremely desirable.

OBJECT AND SUMMARY OF THE INVENTION

It is a principal object of the invention to provide a high performance feeder mechanism for individual sheets as well as for folded sheets of paper or similar material, whose speed is a multiple of the operating speed of such feeders at the present time and which furthermore does not exhibit the above-mentioned disadvantages which are inherent in known feeder mechanisms.

This and other objects are attained by the invention by providing a pair of suction devices operating in opposite phase for a preliminary separation of an individual item in the stack of items to be processed and further by providing a conveyor wheel with several recesses wherein individual items are grasped and delivered to a conveyor mechanism which pulls the individual item out of the stack. The conveyor wheel bends an item away from the stack so that, long before that item is actually removed from the stack, the other suction device is able to move to the next item in the sequence and pull it from the stack so that the individual items come to lie on top of one another in staggered fashion. A complete singularization then takes place by subsequent accelerator mechanisms. It will be noted that the individual items are pulled from the stack at a relatively low velocity initially so that the final velocity is not imparted to the material in a single accelerating process but rather in stepwise manner. The substantial increase in the operating speed is due primarily to the presence of double sets of suction cups which operate in opposite cyclic phase and which are able to pull items from the stack initially in staggered array. A further operating speed increase is obtained by including the vacuum control mechanism in the pivoting suction mechanism, thereby producing a very short path from the control valve to the suction cup. The alternating motion of the suction cups is performed by a simple lever drive which operates without exhibiting any torque peaks.

The supply rack for the apparatus according to the invention is similar to an accumulator belt which brings the advantage that it may be refilled by hand but may also be connected directly to a conveyor belt which supplies the product in staggered array which permits the direct connection to, for example, a rotating newsprint machine without any intermediate handling and restacking.

Accordingly, this high performance feeder mechanism is able to fulfill the main requirement for a rapidly running insertion machine which is used in newspaper processing. A prototype of the feeder mechanism according to this invention has already achieved operating speeds of 40,000 items per hour.

The invention will be better understood as well as further objects and advantages thereof become more apparent from the following detailed description of a preferred embodiment taken in conjunction with the drawing.

DESCRIPTION OF THE PREFERRED EMBODIMENT

Figure 1:
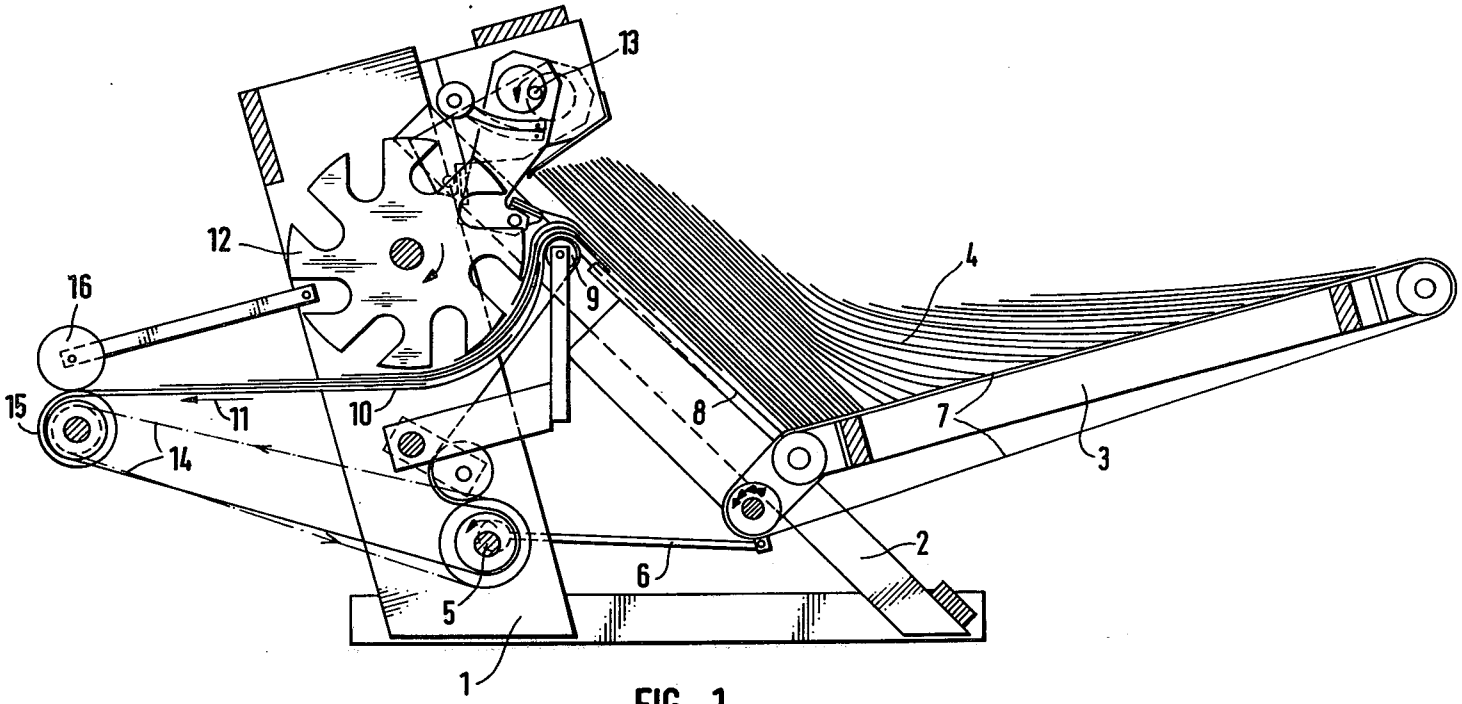
FIG. 1 is a side elevational view of the feeder mechanism according to the invention.

The feeder mechanism according to the invention is illustrated in an exemplary embodiment in FIG. 1 which shows a main frame 1 including an oblique rail 2 on which there is displaceably located a serving platform 3 on which stacks or staggered arrays of the items (individual sheets, folded sheets, etc.) may be placed either by hand or automatically for eventual individual removal. A main drive shaft 5 acts through a crank and a connecting rod 6 to power a group of adjacently disposed conveyor belts 7 in discrete steps with freewheeling operation so that the items placed on the conveyors are transported in discrete, stepwise motions to the feeder platform 8 where they are automatically erected to assume an inclined position in such a way that their upper edges extend beyond a reversing roller 9 and are located in positions in which they are accessible to the suction cups. The height of the serving platform is so adjusted that the upper edge of each of the items to be processed will extend to the same height in each case.

Figure 2:
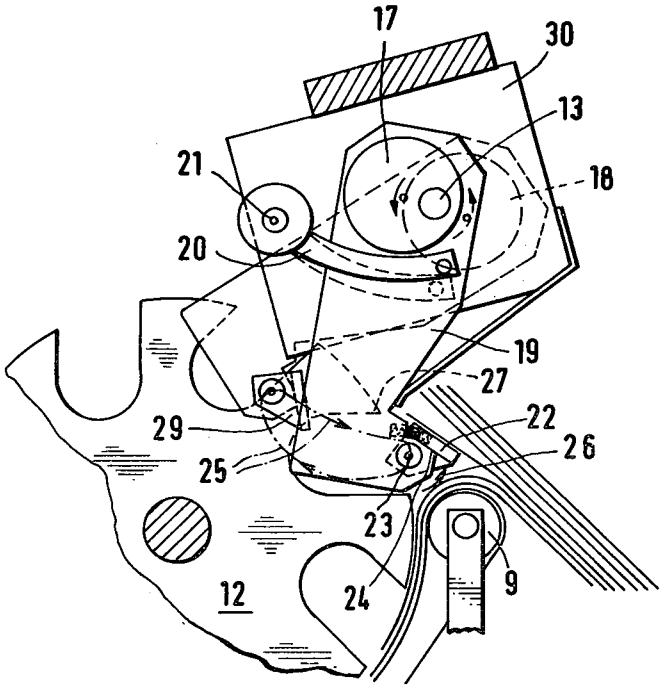
FIG. 2 is a detailed illustration of the suction cup operating mechanism and one conveyor wheel.
Figure 3:
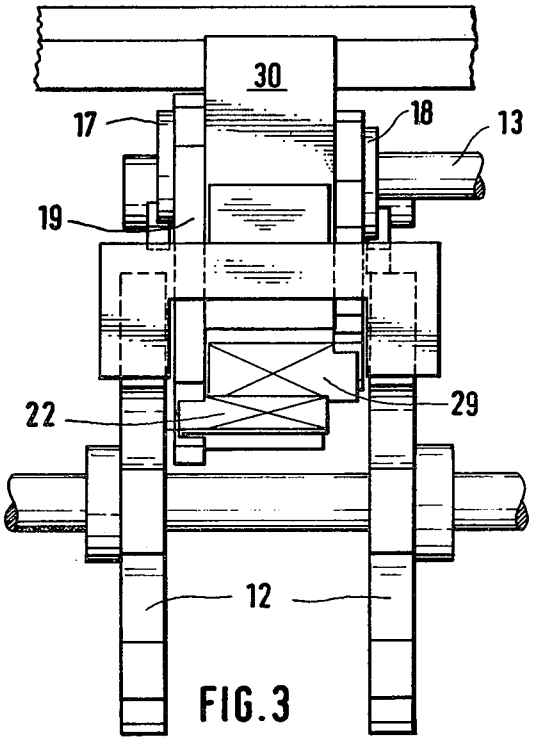
FIG. 3 is an end elevational view of the apparatus according to the invention.
Figure 4:
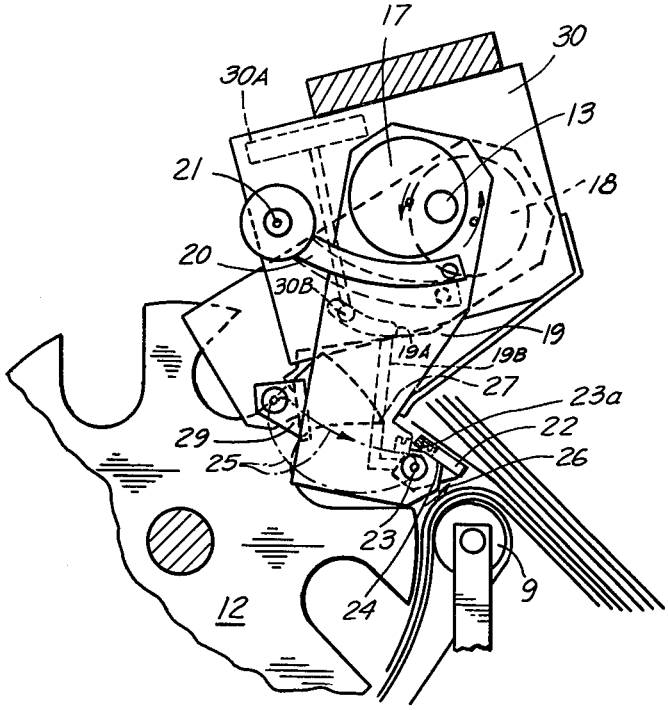
FIG. 4 shows the structure of FIG. 3 and the connection between a source of vacuum and one of the suction device.

The main drive shaft 5 also drives conveyor belts 10 in the direction of the arrow 11 and furthermore, via chains or drive belts (not shown) it drives two conveyor wheels 12 in the direction of the arrow. The suction cup drive shaft 13 is also driven in the direction of the arrow and a belt drive 14 powers accelerator rollers 15 which cooperate with counter-pressure rollers 16. In the exemplary embodiment shown, the conveyor wheels 12 have eight uniformly distributed recesses so that these wheels 12 complete $\frac{1}{8}$ of a revolution per operating cycle. The suction cup drive shaft 13 includes two eccentric bearings 17, 18 mutually displaced by 180°, each of which acts as the drive crank for a four-jointed linkage that moves the suction cups back and forth. The four-jointed linkage for the foremost suction-operated sheet withdrawing device or cup 22 in FIG. 2 includes the eccentric crank 17, a connecting rod or support 19 and a lever 20 which latter is able to pivot around a locally fixed axis 21. In FIG. 2, the suction cup 22 is disposed rotatably about the axis of a coupling pin 23 behind the connecting rod 19 and is held in its normal position adjacent a surface of the connecting rod 19 24 by a compression spring **23*a* (see FIG. 4). While the suction cup 22 moves along the curve or path 25 traced by the connecting rod 19, it is supplied with vacuum when in the vicinity of the first sheet to be removed so that it adheres to that sheet by suction. During the further motion, the suction cup is forced to rotate about the axis of the coupling pin 23 in the direction of the arrow 26 while the compression spring 23*a* yields, and it thus bends the upper edge or the upper fold of the first item from the stack. Subsequently, an upper corner 27 on each of the conveyor wheels 12 engages the upper edge of the sheet and thus pulls the bent sheet over the reversing roller 9 in the downward direction until it is pinched between the conveyor wheels 12 and the reversing roller and is gradually pulled further out of the stack. During this process, however, the second suction cup 29 has arrived at the bottom surface of the stack and is already engaged in removing the second item in the stack in the same manner so that, when the next recesses in the conveyor wheels 12 arrive, the respective corners 27 engage the second sheet and cause it to be pinched between the conveyor wheels and the reversing roller. The relatively close sequencing of the recesses in the conveyor wheels 12 results in a staggered array of the individual items taken from the stack which are then pulled further apart by the accelerator rollers 15 cooperating with their counter-rollers 16**.

Since the second suction cup 29 is driven by a mirror image mechanism at 180° phase displacement, the shaft 13 executes $\frac{1}{2}$ revolution per operating cycle. The connecting rod of each of the linkages is made relatively large so that it is possible to use the bearing which carries the two connecting rods to serve at the same time as the vacuum control mechanism and by letting the motion of the connecting rods themselves cause the opening and closing of the valve and thereby control the admission of vacuum to the respective suction cups. For this purpose, the bearing 30 is provided with a source 30A of vacuum (see FIG. 4) and a lateral air evacuating bore 30B in suitable locations through which the air evacuating slots 19A and bores 19B of the two connecting rods may be coupled with vacuum for a short time during part of their motion, namely, whenever the particular suction cup begins to engage the stack and bends the first item thereof in a downward direction. The above-described construction of the suction mechanism provides very short paths for air flow from the vacuum control valve which, in this case, is formed by the bearing 30, to the individual suction cup.

Since the two suction cups 22 and 29 operate in alternate manner, it is unnecessary to have a separate retainer mechanism for the remaining stack because a particular item is pulled from the stack only after the other suction cup has already arrived at the stack and holds its respective item in a fixed manner just at the time when the previous item is being accelerated between the conveyor wheels 12 and the reversing roller 9. Accordingly, there are present no mechanisms which would require additional reciprocating drive means so that, during one cycle, the driving torque exhibits no particular fluctuations or peaks which would necessitate the presence of a more powerful motor drive. Accordingly, the power required for driving the high performance feeder mechanism according to the present invention is relatively small.

The foregoing pertains to a preferred exemplary embodiment of the invention, it being understood that many modifications thereof are possible within the spirit and scope of the invention, the latter being defined by the appended claims.

What is claimed is:

1. A sheet feeder apparatus, comprising receiver means for holding a supply of overlapping flexible sheets which include a foremost sheet having an edge portion that is exposed at one side thereof and a plurality of next-following sheets each having an edge portion which faces the edge portion of the preceding sheet; a plurality of staggered suction-operated sheet withdrawing devices; means for moving successive devices along discrete paths having sections extending along said edge portions of the foremost and next-following sheets of said supply so that a preceding device engages and deflects said edge portion of the foremost sheet away from the edge portion of the immediately following sheet and the oncoming device engages and deflects the thus exposed edge portion of the immediately following sheet, said moving means including discrete supports for said devices and means for articulately coupling said devices to the respective supports so that each device can lie substantially flush against the edge portion of the adjacent sheet during movement along said section of the respective path; and conveyor means including means for engaging the deflected edge portions of successive sheets and for transporting such sheets away from said supply.

2. A sheet feeder apparatus as defined in claim 1, wherein said engaging means includes conveyor wheel means having a series of evenly spaced peripheral recesses which receive the deflected edge portions of successive sheets.

3. A sheet feeder apparatus as defined in claim 1, wherein said receiver means includes platform means for partially supporting said supply and wall means for partially supporting the foremost sheet of said supply, said platform means and said wall means making an obtuse angle.

4. A sheet feeder apparatus as defined in claim 1, wherein said moving means further comprises rotary crank means for each of said supports and each arranged to pivot the respective support, said devices including a first and a second device and the crank means for said first and second devices being angularly offset with respect to each other by 180°.

5. A sheet feeder apparatus as defined in claim 1, wherein said coupling means includes pivots for the respective devices and further comprising means for yieldably opposing pivotal movement of said devices in one direction with respect to the corresponding pivots.

6. A sheet feeder apparatus as defined in claim 1, wherein said moving means defines air evacuating passages, one for each of said devices and each having an inlet connected with the respective device, said supports having means for sealing the respective passages during movement of said devices along predetermined second sections of the respective paths.

* * * * *